US011731293B2

(12) United States Patent
Nelson, III

(10) Patent No.: US 11,731,293 B2
(45) Date of Patent: Aug. 22, 2023

(54) FOLDING KNIFE WITH BIDIRECTIONAL ACTUATOR

(71) Applicant: Holy Grail Forge, LLC, Byram, MS (US)

(72) Inventor: Robert Edwin Nelson, III, Canon City, CO (US)

(73) Assignee: Holy Grail Forge, LLC, Byram, MS (US)

( * ) Notice: Subject to any disclaimer, the term of this patent is extended or adjusted under 35 U.S.C. 154(b) by 0 days.

(21) Appl. No.: 17/365,240

(22) Filed: Jul. 1, 2021

(65) Prior Publication Data

US 2022/0016790 A1 Jan. 20, 2022

Related U.S. Application Data

(60) Provisional application No. 63/052,024, filed on Jul. 15, 2020.

(51) Int. Cl.
*B26B 1/04* (2006.01)
*B26B 1/10* (2006.01)

(52) U.S. Cl.
CPC ..... *B26B 1/042* (2013.01); *B26B 1/048* (2013.01); *B26B 1/10* (2013.01)

(58) Field of Classification Search
CPC .... B26B 1/00; B26B 1/02; B26B 1/04; B26B 1/042; B26B 1/048; B26B 1/10
See application file for complete search history.

(56) References Cited

U.S. PATENT DOCUMENTS 4,173,068 A * 11/1979 Cargill ..... B26B 1/048 30/161
6,145,202 A * 11/2000 Onion ..... B26B 1/048 30/160
6,289,592 B1 * 9/2001 Emerson ..... B26B 1/046 30/344
6,308,420 B1 * 10/2001 Moser ..... B26B 1/04 30/158

(Continued)

FOREIGN PATENT DOCUMENTS

CN 104703763 A 6/2015
RU 2533891 C2 11/2014

*Primary Examiner* — Adam J Eiseman
*Assistant Examiner* — Richard D Crosby, Jr.
(74) *Attorney, Agent, or Firm* — Martenson IP; Chad G. Clark; Jack F. Stuart, II

(57) ABSTRACT

A bolster-actuated folding knife may have a folding knife blade whose opening and closing is controlled by an actuator on the knife's handle. This bolster-actuator may rotate in either of two rotational directions about the same pivot as the knife blade. When a user rotates the bolster-actuator in one direction, the bolster's pin may impinge via direct contact with the knife blade forcing the knife blade fully open. When a rotates the bolster-actuator in the opposite direction bolster-actuator rotation and thus bolster pin deflection may cause the knife's locking tab to disengage from a cutout in the knife blade, unlocking the knife blade from its fully locked-open position and urging the knife blade to close. Thus, the bolster-actuated folding knife may provide a convenient means to open and close a locking, folding knife with only one hand, and without substantial interference with the knife's aesthetic appeal.

12 Claims, 14 Drawing Sheets

(56) References Cited

U.S. PATENT DOCUMENTS 6,338,431 B1 * 1/2002 Onion ..... B26B 1/048 30/160
6,378,214 B1 * 4/2002 Onion ..... B26B 1/048 30/160
6,397,477 B1 * 6/2002 Collins ..... B26B 1/046 30/155
6,427,334 B2 * 8/2002 Onion ..... B26B 1/048 30/162
6,427,335 B1 * 8/2002 Ralph ..... B26B 1/048 30/160
6,430,816 B2 * 8/2002 Neveux ..... B26B 1/046 30/158
6,434,831 B2 * 8/2002 Chen ..... B26B 1/048 30/155
6,591,504 B2 * 7/2003 Onion ..... B26B 1/048 30/160
6,675,484 B2 * 1/2004 McHenry ..... B26B 1/046 81/177.4
6,732,436 B2 * 5/2004 Moizis ..... B26B 1/046 30/155
6,810,588 B1 * 11/2004 Cheng ..... B26B 1/046 30/160
6,941,661 B2 * 9/2005 Frazer ..... B26B 1/048 30/160
7,000,323 B1 * 2/2006 Hatcher ..... B25F 1/04 30/155
7,080,457 B2 * 7/2006 Sullivan ..... B26B 1/046 30/160
7,380,340 B1 * 6/2008 Lerch ..... B26B 1/02 30/159
7,421,751 B2 * 9/2008 Ruggiero ..... B26B 1/048 30/155
7,458,159 B2 * 12/2008 Galyean ..... B26B 1/04 30/159
7,469,476 B2 * 12/2008 Demko ..... B26B 1/042 30/160
7,506,446 B2 * 3/2009 Onion ..... B26B 1/048 30/160
7,581,321 B2 * 9/2009 Kain ..... B26B 1/048 30/155
7,774,939 B1 * 8/2010 Onion ..... B26B 1/048 30/160
7,774,940 B2 * 8/2010 Frank ..... B26B 1/044 30/155
8,001,693 B2 * 8/2011 Onion ..... B26B 1/02 30/155
8,307,555 B2 * 11/2012 Onion ..... B26B 1/044 30/155
8,375,589 B2 * 2/2013 Bremer ..... B26B 1/046 30/155
8,813,367 B1 * 8/2014 Linn ..... B26B 1/046 30/161
9,061,426 B2 * 6/2015 Harvey ..... B26B 1/042
9,427,878 B2 * 8/2016 Hernandez ..... B26B 1/048
9,527,218 B2 * 12/2016 Valdez ..... B26B 1/044
9,539,733 B2 * 1/2017 Jennings ..... B26B 5/003
9,815,212 B2 * 11/2017 Barr ..... A45D 24/08
10,391,645 B2 * 8/2019 Trull ..... B25B 15/00
11,052,549 B2 * 7/2021 DeBaker ..... B26B 1/044
2002/0104220 A1 * 8/2002 Marfione ..... B26B 1/046 30/160
2002/0157260 A1 * 10/2002 Cheng ..... B26B 1/044 30/155
2003/0226260 A1 * 12/2003 Sullivan ..... B26B 1/046 30/160
2005/0072004 A1 * 4/2005 Carter, III ..... B26B 1/02 30/158
2005/0097754 A1 * 5/2005 Onion ..... B26B 1/02 30/159
2009/0183375 A1 * 7/2009 Kao ..... B26B 1/02 30/159
2009/0271989 A1 * 11/2009 Van ..... B26B 1/044 30/159
2010/0218383 A1 * 9/2010 Williams ..... B26B 1/02 30/158
2010/0275447 A1 * 11/2010 Perreault ..... B26B 1/046 30/161
2010/0299934 A1 * 12/2010 Van ..... B26B 1/046 30/161
2011/0067246 A1 * 3/2011 Perez ..... B26B 1/044 30/158
2017/0165849 A1 * 6/2017 DeBaker ..... B26B 1/044

* cited by examiner

FOLDING KNIFE WITH BIDIRECTIONAL ACTUATOR

This application is a non-provisional of U.S. Provisional App. Ser. No. 63/052,024, filed Jul. 15, 2020, which is incorporated by reference.

BACKGROUND

Embodiments of the present invention relate, in general, to hand knives with pivoting knife blades.

DESCRIPTION

Overview

Figure 1A:
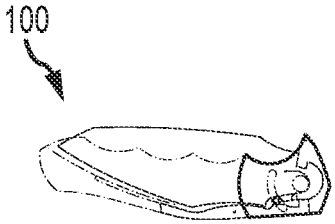
FIG. 1A-D are side views (knife laying horizontal) showing the opening of the knife.
Figure 1E:
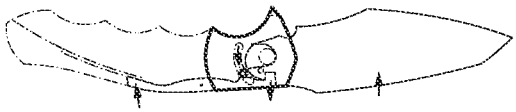
FIG. 1E-H are side views (knife laying horizontal) showing the closing of the knife.
Figure 1B:
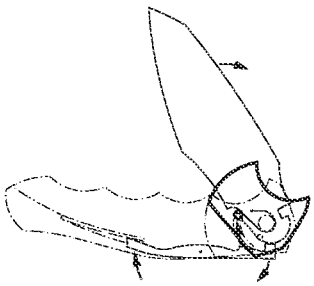
Figure 1F:
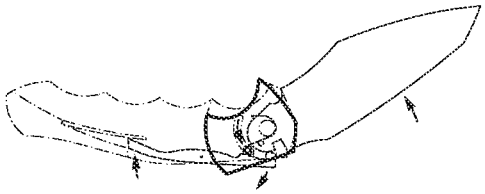
Figure 1C:
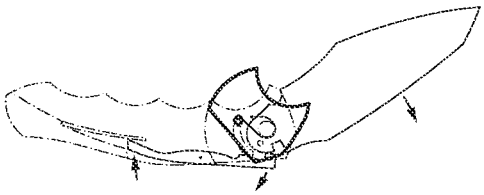
Figure 1G:
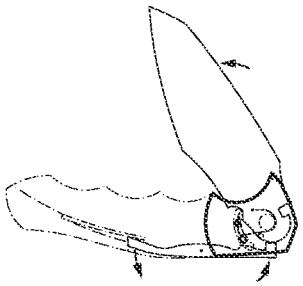
Figure 1D:
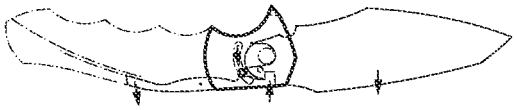
Figure 1H:
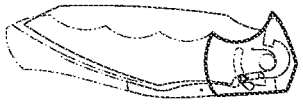

A bolster-actuated folding knife 100 may have a folding knife blade 206 whose opening FIGS. 1A-D, FIGS. 2A-D and closing FIGS. 1E-H, FIGS. 3A-C is controlled by an actuator 202 on the knife's handle 201. The actuator 202 may appear as an ornamental bolster 202 for the knife 100. This bolster-actuator 202 may rotate in either of two rotational directions about the same pivot 203 as the knife blade 206. The knife blade 206 may be rotatably connected to a liner 401 and to the handle 201 at the knife blade pivot 203. The bolster-actuator 202 may have a pin 204 affixed to it that projects inward into the knife body, and travels in a liner slot 205 in the knife's liner 401, with the pin 204 being designed to travel within the curvilinear liner slot 205 in response to actuator 202 rotation. To open the knife 100, starting from when the knife blade 206 is closed, a user rotates the bolster-actuator 202 in one direction FIG. 2B, FIG. 2C, so that the bolster's pin 204 may impinge via direct contact with the knife blade 206, forcing the knife blade 206 to lever fully open FIG. 1D, FIG. 2D about the knife blade pivot 203. To close the knife FIGS. 1E-H, FIGS. 3A-C, starting from when the knife blade 206 is locked open FIG. 2D, a user may rotate the bolster-actuator 202 in the opposite direction FIG. 3A, and that bolster-actuator rotation may cause the bolster's pin 204 to push on the knife's locking arm 402 so that the locking tab 403 disengages from a locking tab cutout 404 in the knife blade 206. That action, in turn, may unlock the knife blade 206 from its fully locked-open position FIG. 1D, FIG. 2D. The locking arm 402 may apply a force FIG. 2B to the knife blade 206 that urges the unlocked knife blade 206 to close by folding into the knife handle 201. Both the pin 204 and liner slot 205 may be concealed from sight in the assembled knife 100. Thus, the bolster-actuated folding knife 100 may provide a convenient means to open and close a locking, folding knife 100 with only one hand, and without substantial interference with the knife's aesthetic appeal.

Additional Features

The knife 100 may also have other features. For instance, the knife 100 may have a locking arm 402 having a locking tab 403, and the locking arm 402 may be rotatably mounted on a locking arm pivot 207 that extends into the handle 201. The locking arm 402 may be rotatably connected to either or both of the liner 401 and the handle 201 at the locking arm pivot 207. The locking arm 402 may be anchored by a locking arm anchor 407, the locking arm anchor 407 being designed to prevent locking arm 402 rotation of the locking arm foot 408 beyond the knife's spine contours, so that the locking arm foot 408 does not protrude beyond those spine contours to impinge into a user's palm at any point during knife blade 206 opening FIGS. 2A-D or closing FIGS. 3A-C.

Further, the locking arm 402 may be forced by a locking arm spring 406 to apply continual force to the knife blade 206. The locking arm spring 406 may be designed to apply force to the locking arm foot 408, so that through the locking arm pivot 602, that force may be translated to locking tab 403 force upon the knife blade 206. The locking arm pivot 207 may be roughly parallel to the knife blade pivot 203 and the locking tab 403 may be arranged to apply a locking tab force to the knife, so that the applied locking tab force maintains the locking tab 403 in constant contact with the knife blade 206. Designed to mate complementarily with the locking tab 403, a locking tab cutout 404 may be designed into the knife blade 206. The locking tab cutout 404 may thus be designed to accept the locking tab 403 to lock the knife blade 206 when the knife blade 206 is rotated to its opened, locked position FIG. 2D, and designed, in response to actuator pin 204 force on the locking arm 402, to clear the locking tab cutout 404 when the knife blade 206 is rotated from its opened, locked position toward its closed position FIGS. 3A-C.

The knife blade 206 may have a choil 600 and a choil notch 601. The choil notch 601 may be designed to accommodate the actuator pin 204, and the actuator pin 204 may be configured to rotate about the knife blade pivot 203 to contact either or both of the choil notch 601 (or the choil 600 alone, if the choil is designed without a choil notch) or the locking arm 402, depending upon whether the knife blade 206 is being actuated open FIGS. 2A-D; actuated closed FIGS. 3A-C; or the knife 100 is in its fully closed position FIG. 2A, respectively.

The knife 100 may have one or more actuator springs 405, with each actuator spring 405 being designed to apply force on the actuator pin 204 such that the actuator 202 returns to a predetermined position FIG. 2A, FIG. 2D, FIG. 3B, FIG. 3C when external force is removed from the actuator 202.

Figure 2A:
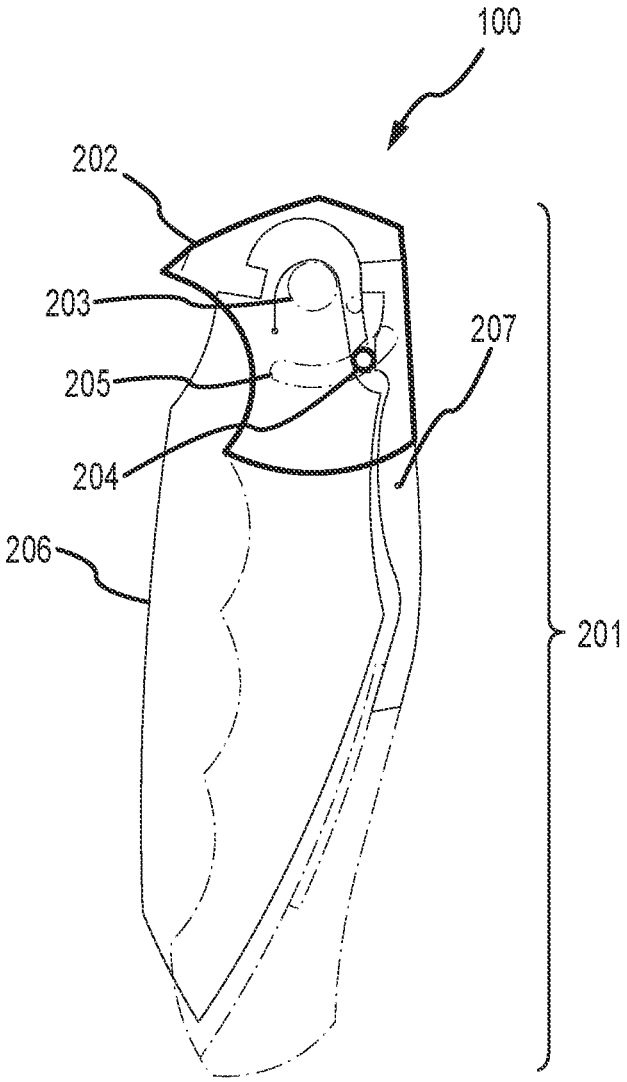
FIG. 2A-D are enlarged side views (knife laying vertical) showing the opening of the knife.
Figure 2B:
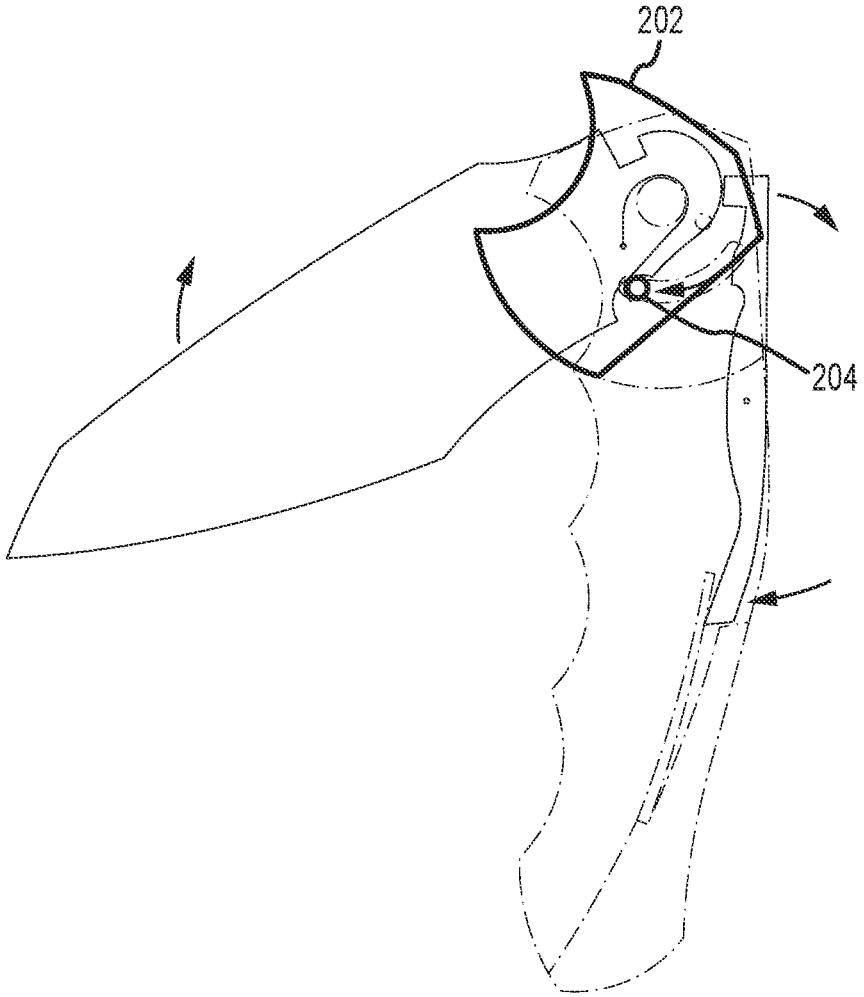
Figure 2C:
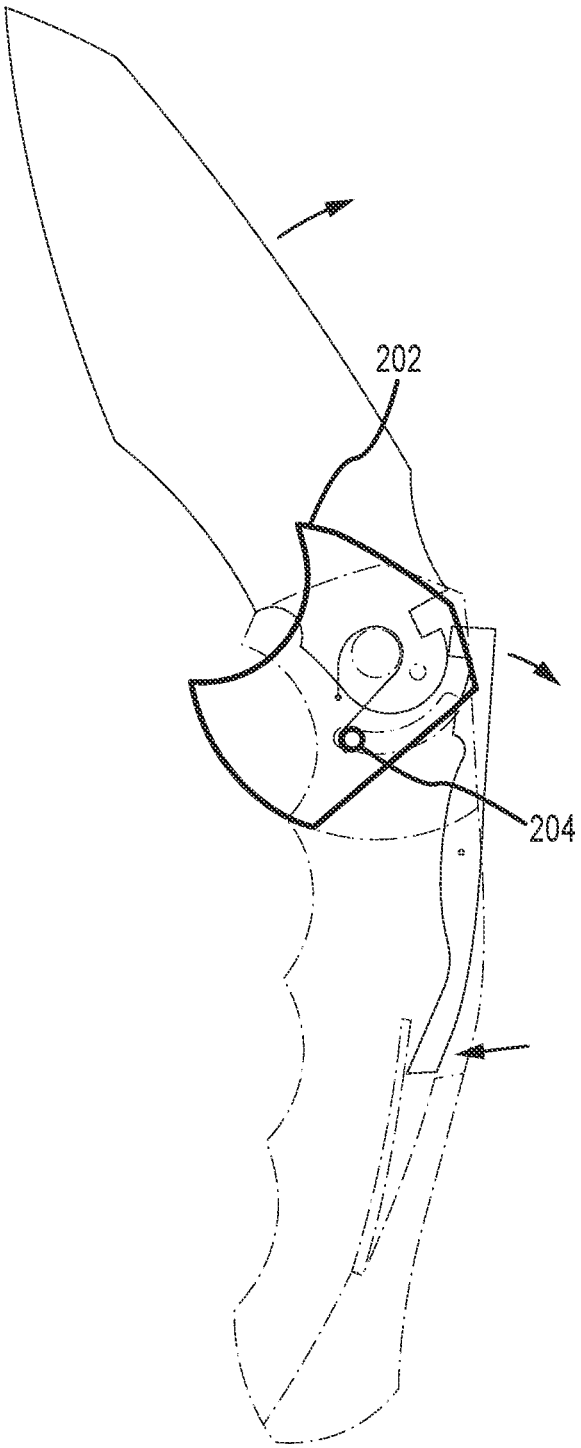
Figure 2D:
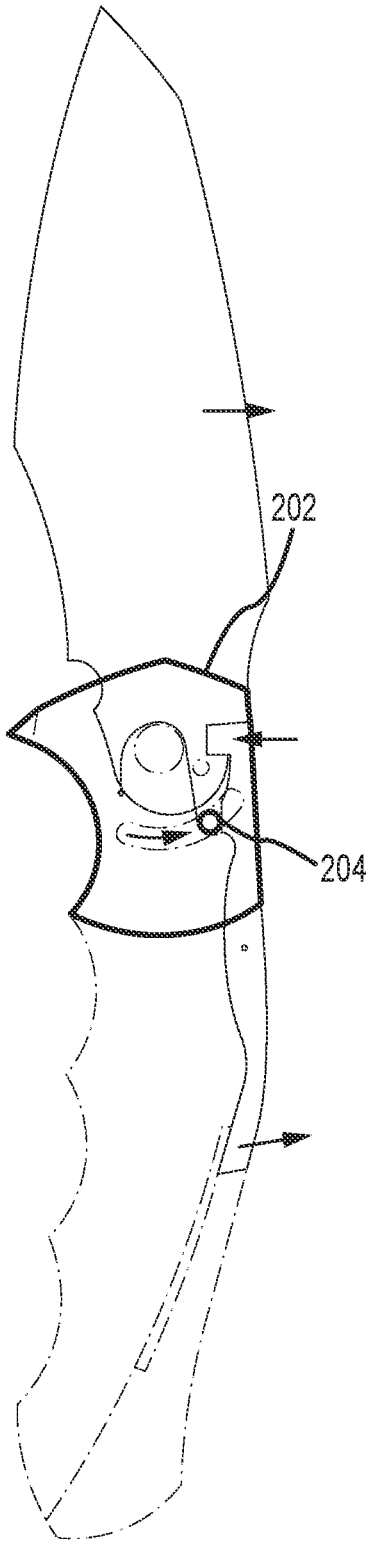
Figure 3A:
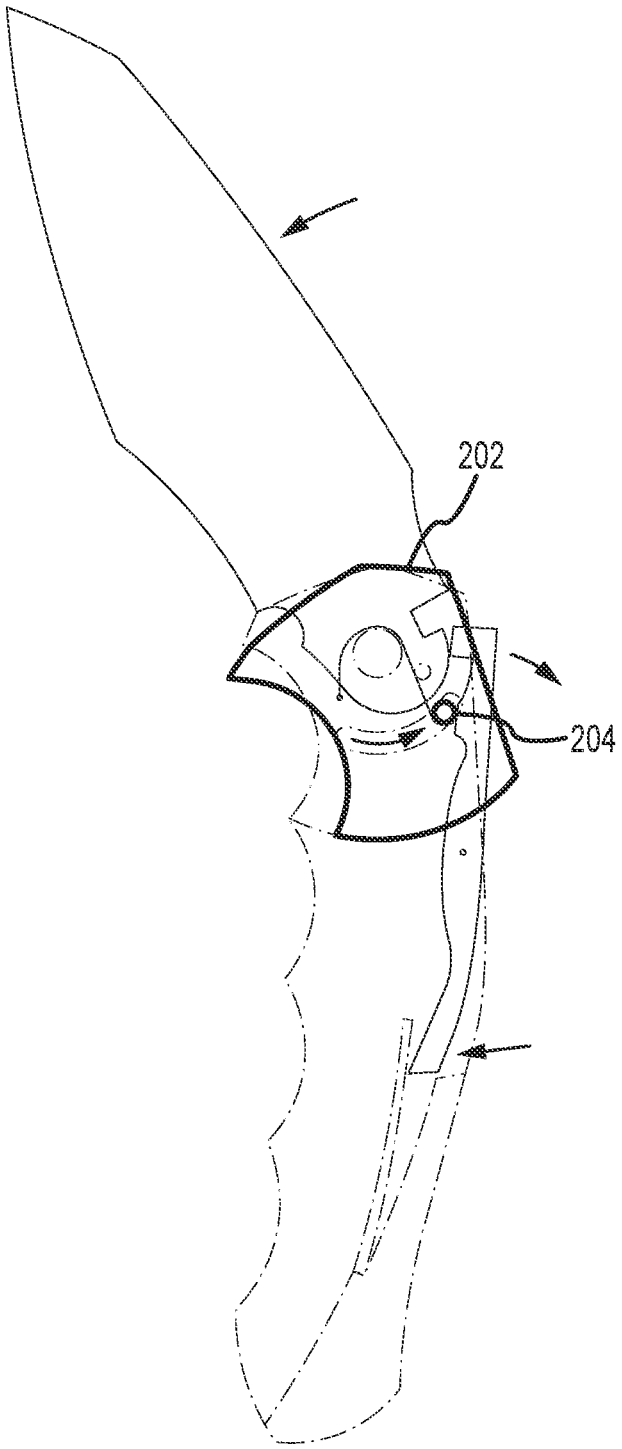
FIG. 3A-C are enlarged side views (knife laying vertical) showing the closing of the knife.
Figure 3B:
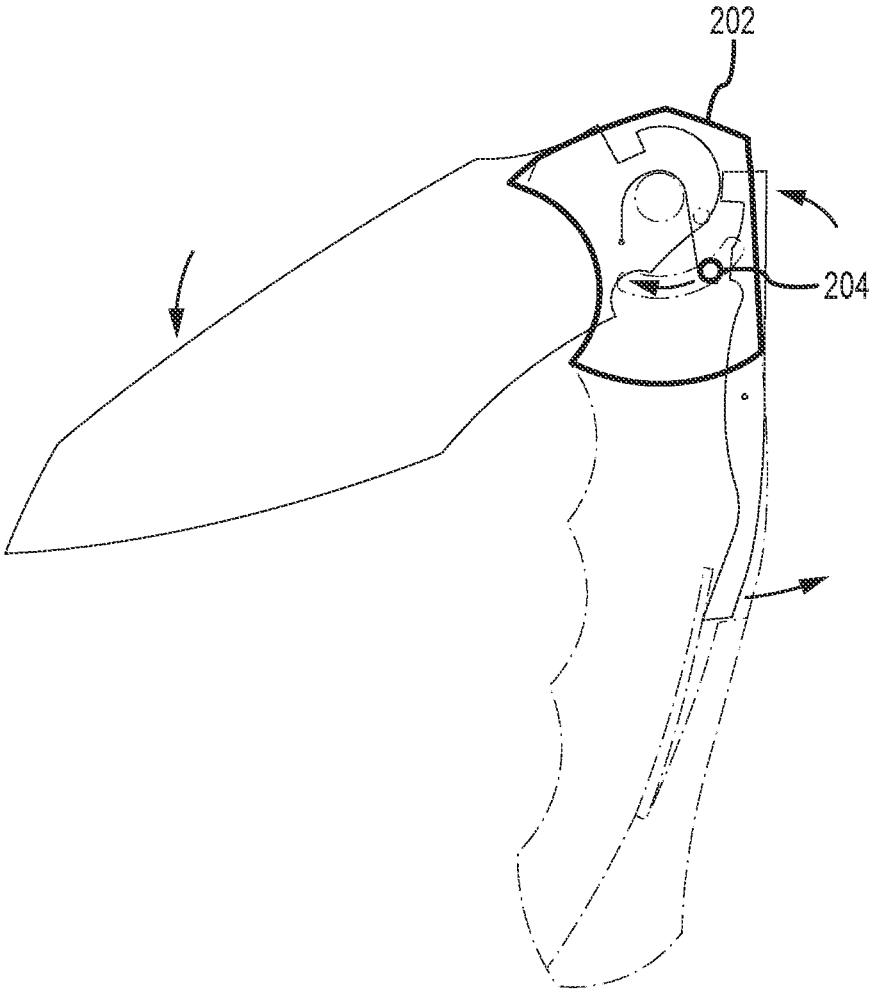
Figure 3C:
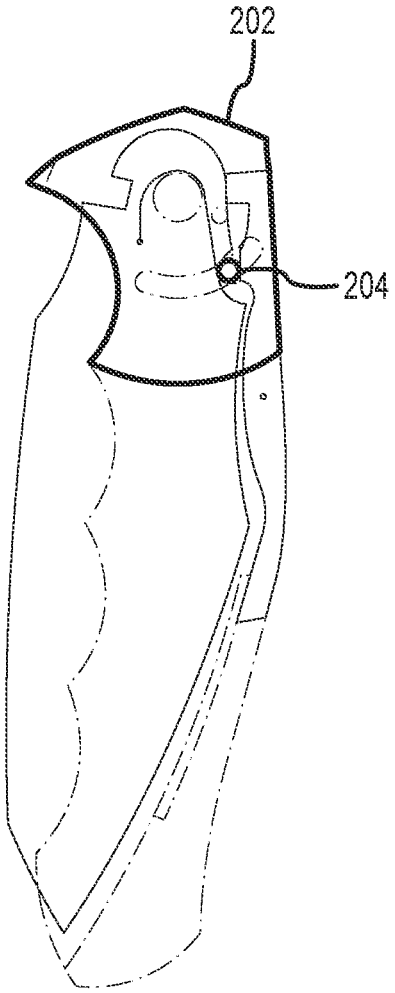
Figure 4:
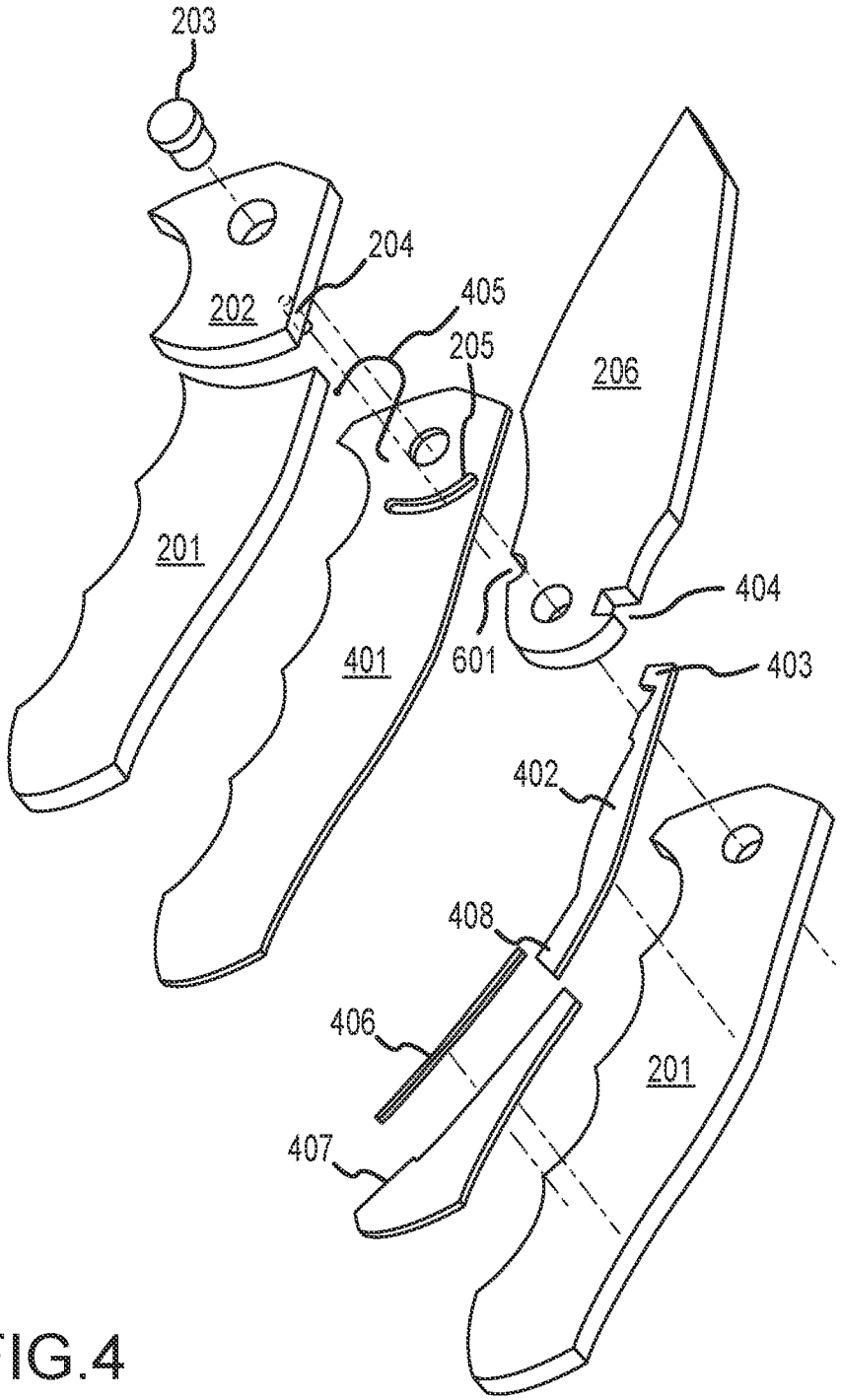
FIG. 4 is an exploded perspective view of the knife showing its components.
Figure 5:
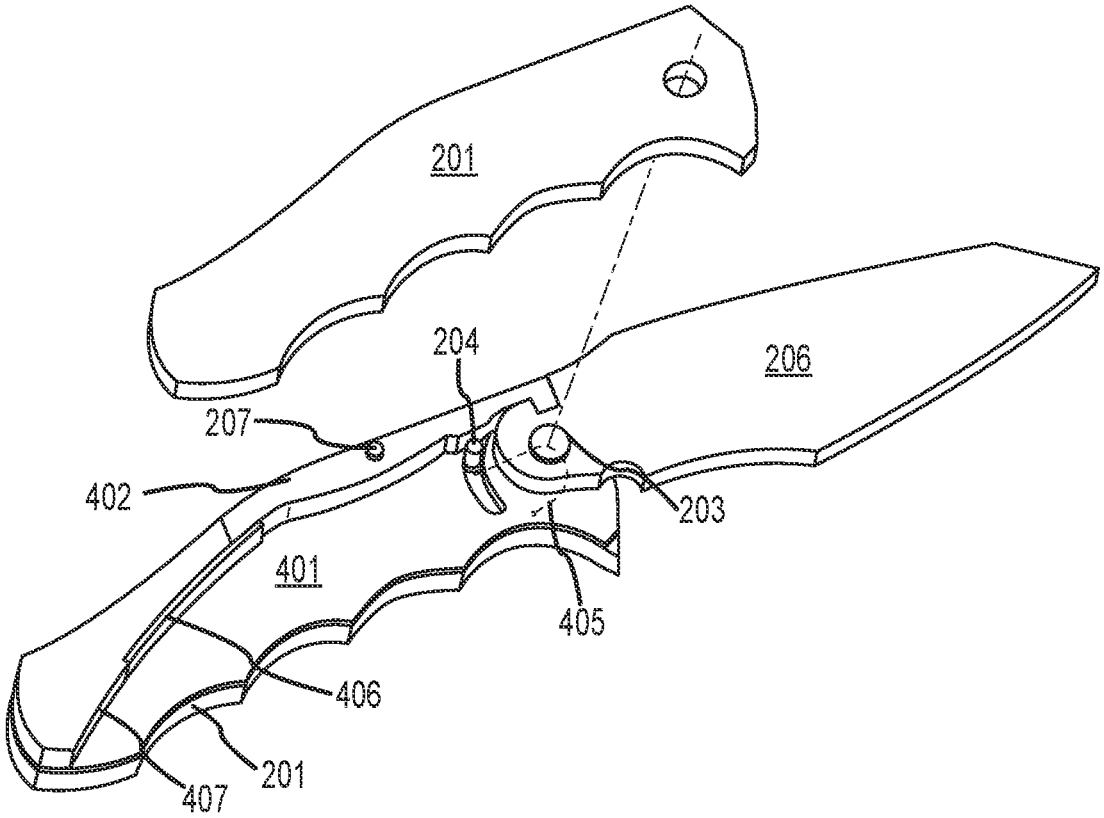
FIG. 5 is a modified cutaway perspective view of the knife, showing the assembled fit of the knife's components.
Figure 6:
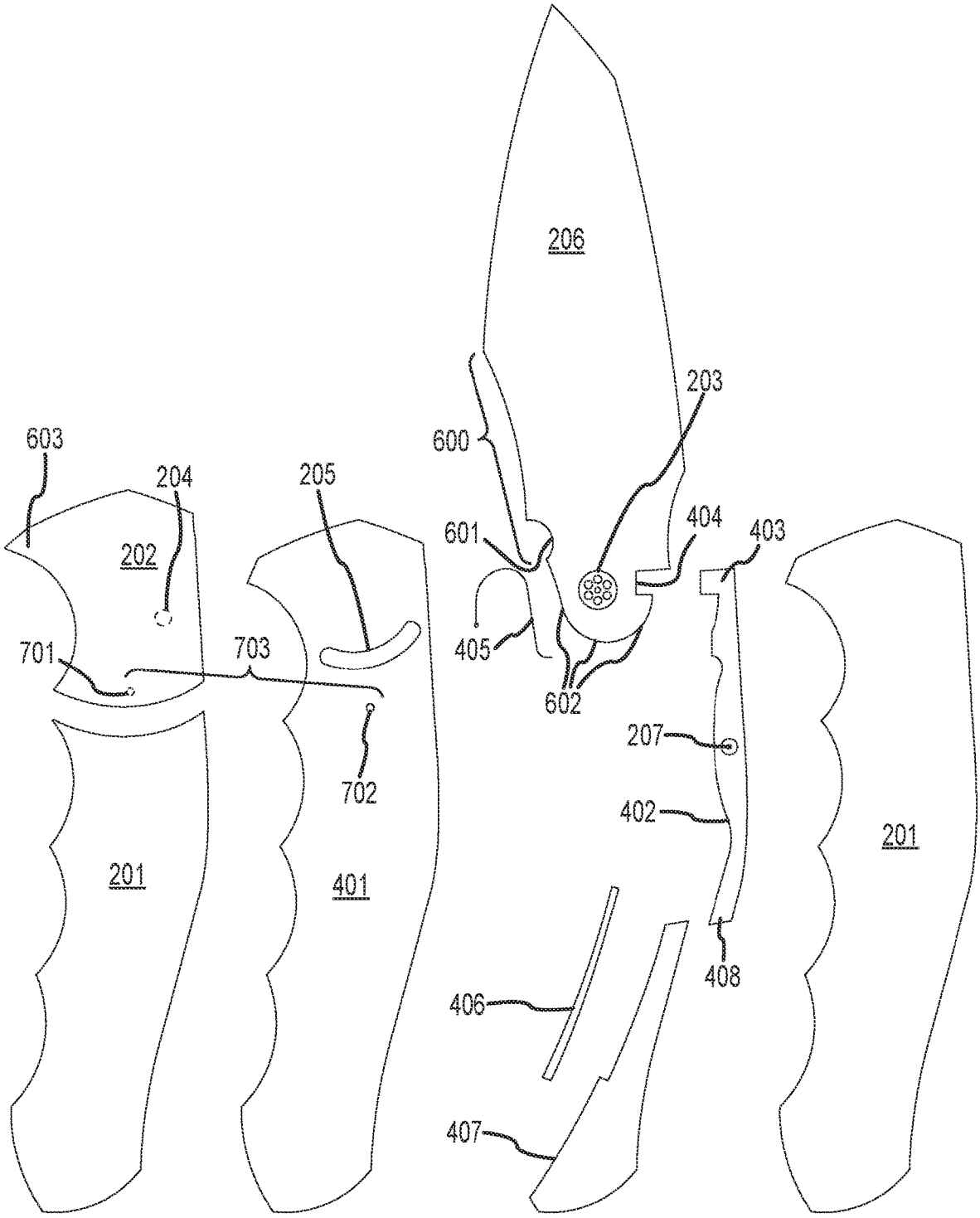
FIG. 6 is a planform view of the knife's unassembled components.
Figure 7A:
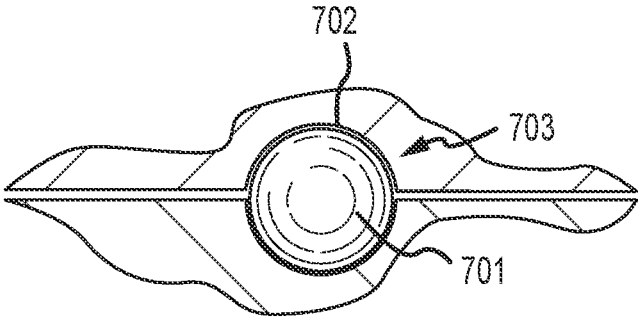
FIG. 7A is a side view of a detent-ball/detent combination.
Figure 7B:
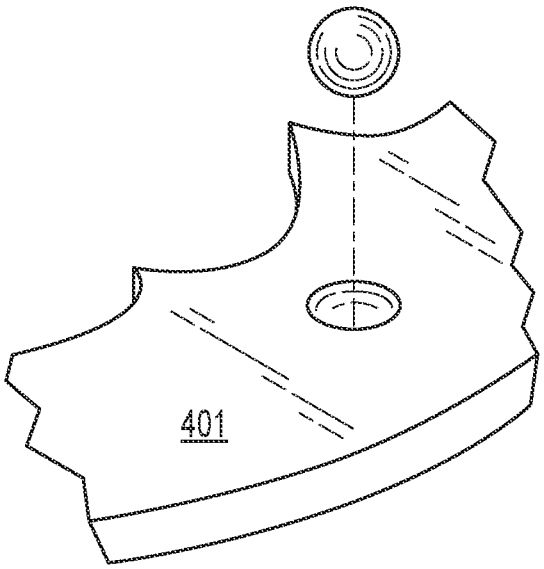
FIG. 7B is a perspective of a detent-ball/detent combination, with the ball suspended above the detent.

The knife 100 may have a knife tang 602, and the tang 602 may be cambered such that the locking tab 403 force applied to the cambered knife tang 602 urges the knife 100 into its closed position FIG. 2A when the knife 100 is unlocked from its open, locked position FIG. 2D. The cambering allows the locking tab 403 to follow the cambered contours of the tang 602, so that the locking tab 403 applies a force to the knife tang 602, and the cambering allows the locking tab 403 to "slide" down the cambered tang 602, urging the knife 100 closed as the locking tab 403 forces the tang 602 to rotate as a result of the tang's cambering.

Also, the bolster-actuator 202 may have a protuberance 603 designed to increase actuator moment (as a function of the increased levering distance from the knife blade pivot 203), and thus the force on the knife blade 206 via the actuator pin 204, when force is applied to the protuberance 603.

The knife 100 may have one or more detent balls 701, and each detent ball 701 may be a spherical bearing 701 set into one knife 100 part—for instance, into a knife liner 401—and corresponding to a detent 702 in another knife 100 part, for instance, the bolster-actuator 202. The detent-ball/detent combination 703 may be designed so that a breakaway force is required to displace (or reposition) each detent ball 701 away from its complementary detent 702, so that the breakaway force imparts an increased force to the actuator 202, and thus to the actuator pin 204, when the actuator 202 is actuated, so that the knife blade 206 has enough angular momentum to fully open without stalling in an intermediately-opening position.

Figure 8:
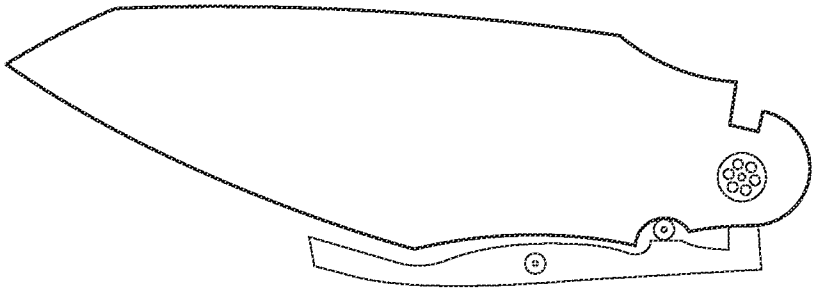
FIG. 8 is a side view (knife blade vertical) of one knife blade/locking arm variation.
Figure 9:
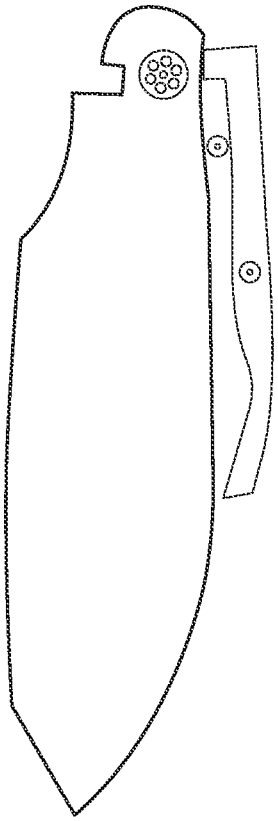
FIG. 9 is a side view (knife blade vertical) of another knife blade/locking arm variation.

The knife blade 206 and locking arm 402 may also be configured in alternative ways, either with a choil notch FIG. 8 or without FIG. 9, and the locking arm may be designed to accommodate these configurations FIGS. 8-9, permitting the use of a variety of knife blade designs.

Various Embodiments and Features

In general, the invention may feature a folding knife 100 comprising a handle 201 and a knife blade 206 mounted into the handle 201 via a knife blade pivot 203 near one end of the handle 201. The handle 201 may have a slot to receive the knife blade 206 and the knife blade pivot 203 may support the knife blade 206 through rotational motion between a retracted position within the slot FIG. 2A and an opened, locked position roughly collinear with the handle FIG. 2D. An actuator 202 may be rotatably mounted on the knife blade pivot 203, and the actuator 202 may have an affixed actuator pin 204 and two rotational directions around the knife blade pivot 203. The knife blade 206 is designed to travel in response to actuator 202 rotation, and the actuator pin 204 is designed, in response to rotation of the actuator 204 in one rotational direction FIGS. 2B-D, to apply force to the knife blade 206 to cause the knife blade 206 to travel between its retracted position within the slot FIG. 2A and its opened, locked position FIG. 2D. The actuator 202 is further designed, in response to rotation of the actuator 202 in the opposite rotational direction FIG. 3A, to unlock the knife blade 206 from its opened, locked position FIG. 2D, to enable the knife blade 206 to close FIG. 3C.

The invention may also feature a folding knife 100 comprising a handle 201 and a liner 401 affixed to the handle 201. The liner 401 may have a curvilinear liner slot 205 and the handle 201 may have a handle slot to house a knife blade 206. The folding knife 100 may also have a locking arm 402 having a locking tab 403, the locking arm 402 rotatably connected to either or both of the liner 401 and the handle 201 at a locking arm pivot 207. A knife blade 206 may be mounted into the handle 201 via a knife blade pivot 203 near one end of the handle 201. The knife blade 206 may have an opening direction FIGS. 2A-D and a closing direction FIGS. 3A-C, and the knife blade 206 may be rotatably connected to the liner 401 and to the handle 201 at the knife blade pivot 203. An actuator 202 may be rotatably mounted on the knife blade pivot 203, and the actuator 202 may have a pin 204 affixed to the actuator 202, and the pin 204 may be designed to travel within the curvilinear liner slot 205 in response to actuator 202 rotation. The pin 204 may be designed to apply force to the knife blade 206 when the actuator 202 is rotated in the opening direction FIGS. 2A-D and the pin may be designed to apply force to the locking arm 402 when the actuator 202 is rotated in the closing direction FIG. 3A.

The invention may also feature a method of using a folding knife 100. As with the above aspects, the knife 100 may have a knife handle 201 and an actuator 202, and the actuator 202 may be rotatably mounted on the knife handle 201. Further, in response to rotation by a human being of the actuator 202 on the knife 100, when rotating the actuator 202 in one rotational direction FIGS. 2B-C, the actuator 202, responsive to actuation, may apply force to a knife blade 206 to cause the knife blade 206 to travel between a retracted position FIG. 2A and an opened, locked position FIG. 2D. And when rotating the actuator 202 in the opposite rotational direction FIG. 3A, the actuator 202, responsive to actuation in the opposite rotational direction FIG. 3A, may unlock the knife blade 206 from its opened, locked position FIG. 2D, to enable the knife blade 206 to close.

The invention may include one or more of the following features, and these features may be used singly, or in combination with each other. The folding knife 100 may further comprise one or more detent balls 701, with each detent ball 701 corresponding to a detent 702 and each detent ball 701 being designed to require a breakaway force to reposition each detent ball 701 away from its complementary detent 702, the breakaway force imparting an increased force to the actuator 202, and thus to the actuator pin 204, when the actuator 202 is actuated. The actuator 202 may have a protuberance 603 designed to increase actuator moment, and thus force on the knife blade 206 via the actuator pin 204, when force is applied to the protuberance 603. The folding knife 100 may have a locking arm 402 having a locking tab 403, and the locking arm 402 may be rotatably mounted on a locking arm pivot 207 in the handle 201—the locking arm pivot 207 being roughly parallel to the knife blade pivot 203 and the locking tab 403 arranged to urge a locking tab force to the knife blade 206—and the locking tab force may be applied to keep the locking tab 403 in constant contact with the knife blade 206. The knife blade 206 may have a locking tab cutout 404 in the knife blade 206, and the locking tab cutout 404 may be designed to accept the locking tab 403 to lock the knife blade 206 when the knife blade 206 is rotated to its opened, locked position FIG. 2D. Further, the locking tab 403 may be designed, in response to actuator pin 204 force on the locking arm 402, to clear the locking tab cutout 404 when the knife blade 206 is rotated FIG. 3A from its opened, locked position FIG. 2D. The knife blade 206 may have a choil 600 and the actuator pin 204 may be configured to rotate about the knife blade pivot 203 to contact either or both of the choil 600 or the locking arm 402. The folding knife 100 may further comprise one or more springs 405, and these one or more springs 405 may be designed to apply force on the actuator pin 204 such that the actuator 202 returns to a predetermined position FIG. 2A, FIG. 2D, FIG. 3B, FIG. 3C when external force is removed from the actuator 202. The folding knife 100 may further comprise a knife tang 602 cambered such that the locking tab 403 force applied to the cambered knife tang 602 urges the knife 100 into its closed position FIG. 2A when the knife 100 is unlocked from its open, locked position FIG. 2D. The choil 600 may have a choil notch 601 and the choil notch 601 may be designed to accommodate the actuator pin 204. The folding knife 100 may have one or more detent balls 701, and each detent ball 701 may correspond to a detent 702 and each detent ball 701 may be designed to require a breakaway force to reposition each detent ball 701 away from its complementary detent 702, so that the actuator 202 applies an enhanced force to the actuator pin 204 when actuated. The actuator 202 may have a protuberance 603 designed to enhance actuator 202 force on the knife blade 206 via the actuator pin 204 when force is applied to the protuberance 603. The folding knife 100 may further comprise a locking tab cutout 404 in the knife blade 206, wherein the locking tab 403 may be designed to constantly apply a locking tab force to the knife 100. The locking tab force may keep the locking tab 403 in constant contact with the knife blade 206, and the locking tab cutout 404 may be designed to accept the locking tab 403, locking the knife blade 206 when the knife blade 206 is rotated to its opened, locked position FIG. 2D. The locking tab 403 may be designed, in response to actuator pin 204 force, to clear the locking tab cutout 404 when the knife blade 206 is rotated from its opened, locked position FIG. 2D. The knife blade 206 may have a choil 600 and the actuator pin 204 may be configured to rotate about the knife blade pivot 203 to contact either or both of the choil 600 or the locking arm 402. The folding knife 206 may further comprise one or more actuator springs 405, and the one or more actuator springs 405 may be designed to apply force on the actuator pin 204 such that the actuator 202 returns to a predetermined position FIG. 2A, FIG. 2D, FIG. 3B, FIG. 3C when external force is removed from the actuator 202. The folding knife 100 may further comprise a knife tang 602 cambered such that the locking tab 403 force applied to the cambered knife tang 602 may urge the knife 100 into its closed position FIG. 2A when the knife 100 is unlocked from its open, locked position FIG. 2D. The choil 600 may a choil notch 601 and the choil notch 601 may be designed to accommodate the actuator pin 204. The method may further comprise using one or more detent balls 701, with each detent ball 701 corresponding to a detent 702, and each detent ball 701 being designed to require a breakaway force to reposition each detent ball 701 away from its complementary detent 702, so that the actuator 202 applies an enhanced force when actuated. The method may further comprise rotating the actuator 202 through the use of a protuberance 603 on the actuator, and the protuberance 603 may be designed to enhance actuator force when force is applied to the protuberance 603. The method may further comprise using one or more actuator springs 405 to apply force to the actuator 202 so that the actuator 202 returns to a predetermined position FIG. 2A, FIG. 2D, FIG. 3B, FIG. 3C when external force is removed from the actuator 202.

The above advantages and features are of representative embodiments only and are not all-inclusive. They are presented only to assist in understanding the invention, thus it should be understood that they are not to be considered limitations on the invention as defined by the claims. Novel features and additional advantages of the invention will become apparent from the above description, the drawings, and the claims. Many of these features will also become apparent to those skilled in the art upon examination of the entire specification or may be learned through practice of the invention.

For clarity of explanation, the above description has focused on a representative sample of all possible embodiments, a sample that teaches the principles of the invention and conveys the best mode contemplated for carrying it out. The invention is not limited to the described embodiments. Well known features may not have been described in detail to avoid unnecessarily obscuring the principles relevant to the claimed invention. Throughout this application and its associated file history, when the term "invention" is used, it refers to the entire collection of ideas and principles described; in contrast, the formal definition of the exclusive protected property right is set forth in the claims, which exclusively control.

The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed alternatives, variations, modifications, and equivalents are within the literal scope of the following claims, and others are equivalent. The claims may be practiced without some or all of the specific details described in the specification. In many cases, method steps described in this specification can be performed in different orders than that presented in this specification, or in parallel rather than sequentially, or in different computers of a computer network, rather than all on a single computer.

I claim:

1. A folding knife, comprising:

a blade;

a handle having a top, a bottom, a front, a back, and a locking arm, wherein the top includes a pivot for mounting the blade, the blade configured to rotate about the pivot between a closed position and an open position, wherein the front includes a slot for storing the blade in the closed position, and wherein in the open position the blade is collinear with the handle and secured in place by the locking arm;

an actuator, rotatably mounted on the pivot, the actuator having an actuator pin and a spring, wherein the actuator is configured to rotate in a first direction and a second direction around the pivot, and the spring is configured to return the actuator to a neutral position, wherein when the blade is in the closed position, rotating the actuator in the first direction causes the actuator pin to rotate the blade around the pivot from the closed position to the open position, and when the blade is in the open position, rotating the actuator in the second direction causes the actuator pin to release the locking arm allowing the blade to rotate around the pivot from the open position.

2. The folding knife of claim 1, the actuator further comprising:

one or more detent balls, wherein each of the one or more detent balls is seated in a corresponding detent when the actuator is in the neutral position, and wherein the actuator requires a breakaway force to unseat the one or more detent balls and rotate out of the neutral position.

3. The folding knife of claim 1, the actuator further comprising:

a trigger configured to impart a moment to the actuator, wherein the moment decreases an actuation force required to rotate the actuator out of the neutral position.

4. The folding knife of claim 1, wherein:

the locking arm further comprising a first end, a second end, and a locking tab located at the first end;

the blade further comprising a locking slot configured to accept the locking tab when the blade is in the open position;

the handle further comprising a locking arm pivot, and a locking arm spring, wherein the locking arm is rotatably mounted on the locking arm pivot, wherein the locking arm spring applies a force to the second end causing the locking tab to maintain contact with the blade, and wherein the locking tab is configured to clear the locking slot when the actuator is moved in the second direction.

5. The folding knife of claim 4, the blade further comprising:

a choil configured to contact the actuator pin when the blade is in the closed position, and wherein the actuator pin imparts force on the blade when the actuator is moved in the first direction.

6. The folding knife of claim 5, wherein:

the choil includes a choil notch configured to mechanically interact with the actuator pin.

7. The folding knife of claim 4, the blade further comprising:

a tang having a camber configured to mechanically interact with the locking tab, wherein the locking arm causes the blade to move to the closed position when the locking tab is clear of the locking slot.

8. The folding knife of claim 1, the handle further comprising:

a liner having a curved slot configured to mechanically interact with the actuator pin, wherein the actuator pin travels within the curved slot when the actuator is moved in the first direction or the second direction.

9. A method of using a folding knife, the method comprising:

rotating an actuator in a first direction from a neutral position, the actuator causing an actuator pin to move a blade from a closed position in a handle to an open position, wherein a locking arm automatically locks the blade in place when the blade reaches the open position;

releasing the actuator, wherein a spring moves the actuator to the neutral position;

rotating the actuator in a second direction from the neutral position, the actuator causing the actuator pin to displace the locking arm from the blade allowing the blade to move to the closed position;

releasing the actuator, wherein the spring moves the actuator to the neutral position.

10. The method of claim 9, wherein:

the actuator includes one or more detent balls, wherein each of the one or more detent balls is seated in a corresponding detent when the actuator is in the neutral position, and wherein the actuator requires applying a breakaway force to unseat the one or more detent balls and rotate out of the neutral position.

11. The method of claim 10, wherein:

the actuator includes a trigger configured to impart a moment to the actuator, wherein the moment decreases an actuation force required to rotate the actuator out of the neutral position.

12. The method of claim 11, wherein:

the locking arm includes a locking tab;

the blade includes a locking slot and a tang, wherein the locking slot is configured to interact with the locking tab, and wherein the tang includes a camber configured to mechanically interact with the locking tab, wherein the locking arm causes the blade to move automatically to the closed position when the actuator pin displaces the locking tab clear of the locking slot.

* * * * *